United States Patent [19]

Barthel

[11] 4,027,151

[45] May 31, 1977

[54] LUMINAIRE AND REFLECTOR THEREFOR

[75] Inventor: Frank S. Barthel, North Syracuse, N.Y.

[73] Assignee: Crouse-Hinds Company, Syracuse, N.Y.

[22] Filed: Nov. 18, 1975

[21] Appl. No.: 633,135

[52] U.S. Cl. ..... 240/41.35 R; 240/51.11 R; 240/103 R; 350/294

[51] Int. Cl.[2] ..... F21V 7/00; F21V 7/09

[58] Field of Search ..... 240/41.35 R, 103 R, 240/51.11 R; 350/293, 294

[56] References Cited

UNITED STATES PATENTS 3,679,893 7/1972 Shemitz ..... 240/51.11 R

FOREIGN PATENTS OR APPLICATIONS 1,183,764 7/1959 France ..... 240/41.35 R 471,347 5/1969 Switzerland ..... 240/41.35 R

*Primary Examiner*—Richard L. Moses

*Attorney, Agent, or Firm*—Sughrue, Rothwell, Mion, Zinn and Macpeak

[57] ABSTRACT

A luminaire for providing uniform illumination of a horizontal or vertical plane surface is provided with a reflector having three distinct contours to provide optimum distribution of light flux. The first section is cylindrical and extends from 117° to 180° from nadir. The second section is a general contour curve extending from 180° to 270° from nadir and is used to redirect flux in the zone from nadir to 65°. The third section is a general contour curve extending from 270° to 355° from nadir and redirects the flux in the zone from 50° to 65° from nadir. The general contour curves in sections 2 and 3 are defined by fourth degree polynominal equations.

4 Claims, 4 Drawing Figures

FIG. 2
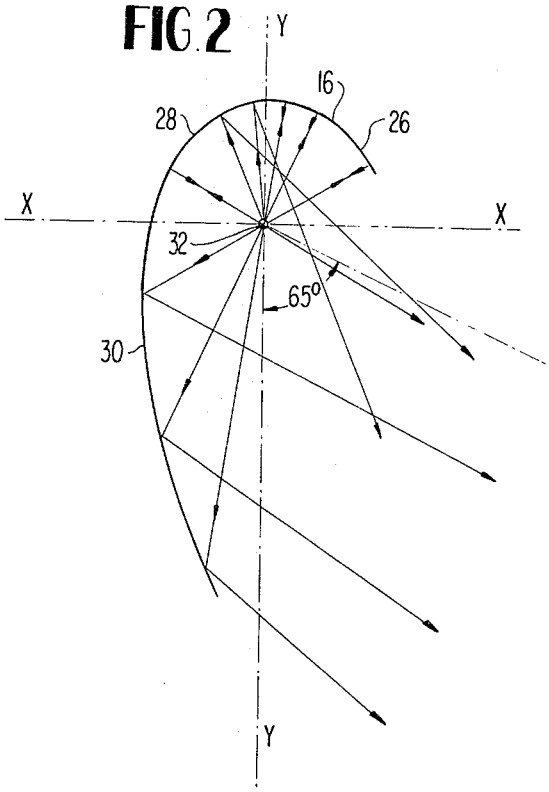
FIG. 1
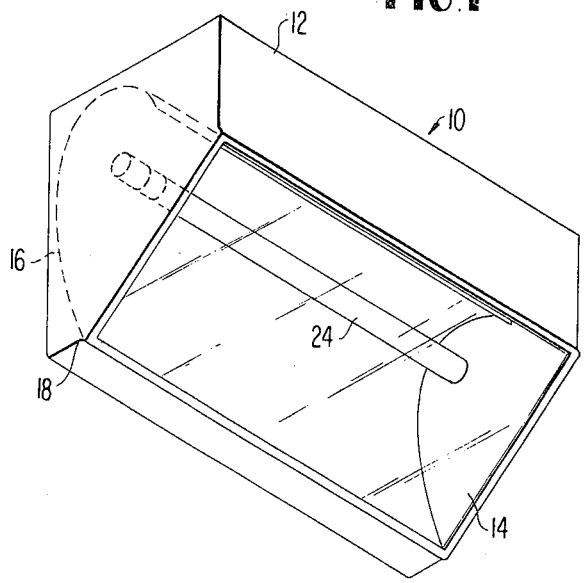
FIG. 4
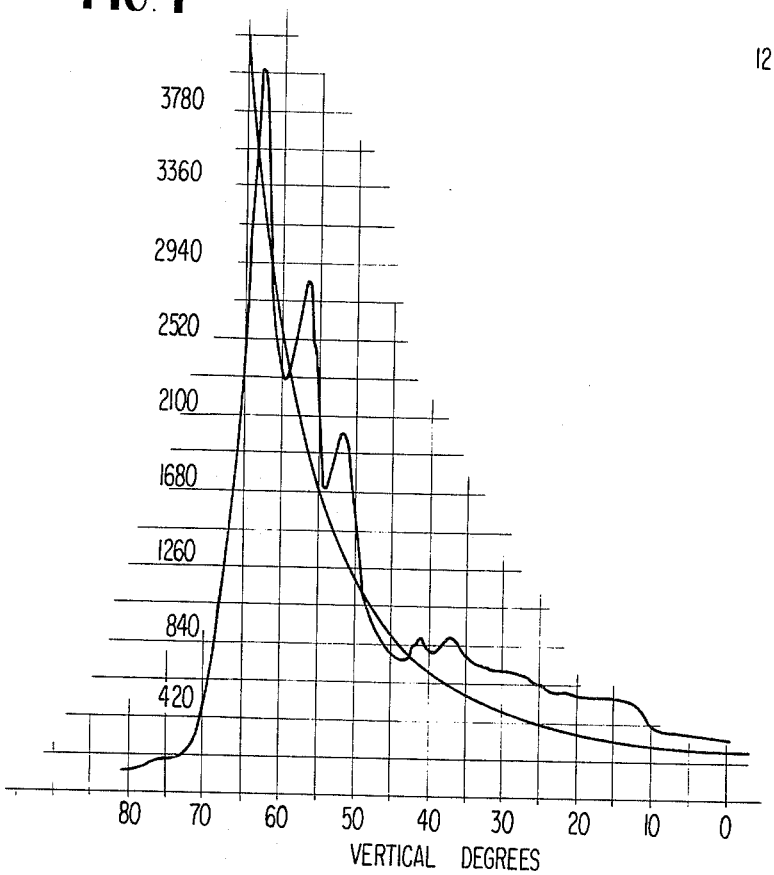
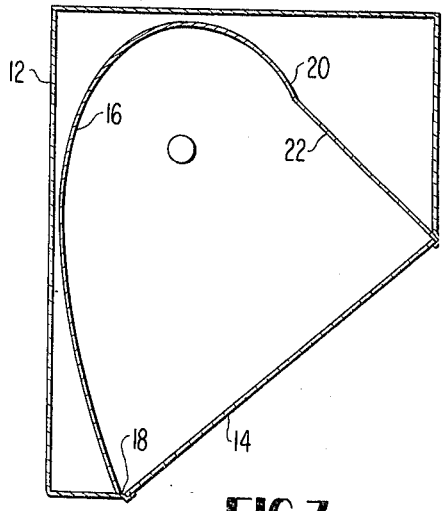
FIG. 3

LUMINAIRE AND REFLECTOR THEREFOR

BACKGROUND OF THE INVENTION

1. Field of the Invention

The present invention is directed to luminaires for providing a uniform illumination on a planar surface and more specifically to the reflector for such a luminaire to achieve such uniform illumination.

2. Background of the Invention

In order to provide uniform horizontal illumination on a plane, it is a well known fact that the inverse square law $E = I \cos\theta/d^2$ must be satisfied. In order to provide constant illumination the luminaire must provide 13.245 times the intensity at angle $\theta$ of 65° as is provided at nadir. This contribution must be the sum of both the direct and reflected components. If the direct component is the same at both nadir and 65°, the reflected component at 65° must satisfy the following relationship:

Direct component (65°) + reflected component (65°) = 13.245 (direct component 0° + reflected component 0°).

In determining the resultant luminaire distribution and contour it is necessary to take into consideration the size of the light source as well as its position relative to the reflector contour.

Various reflector schemes have been devised in an attempt to provide uniform illumination on the horizontal plane. Most attempts have failed because the investigators did not consider all of the factors which affect the radiation emanating from the luminaire. Some of the factors include light source size, relationship of source to the contour, optical character of the reflecting material and/or refracting material, physical blockages imposed by other components, etc.

Some prior art luminaires have utilized reflectors which are comprised of parabolic and elliptical curves in an attempt to achieve an even light distribution of a planar surface. Some of these prior art luminaires specifically avoided the use of cylindrical curvatures for any part of the reflector since it was considered undesirable to have the light reflected directly back through the light source which would be located at the center of the cylindrical portion.

SUMMARY OF THE INVENTION

The present invention provides a reflector for a luminaire which is comprised of three distinct contours to provide optimum distribution of light flux on a planar surface such as the wall of a building, a vertically disposed sign or a horizontal surface such as a roadway. For illuminating vertical planes such as the wall of a building or a sign board the luminaire having the reflector according to the present invention would be located adjacent the lowermost edge of the sign but spaced outwardly therefrom along the nadir so that the angle between nadir and 65° would encompass the desired vertical dimension. In the case of a horizontal surface such as a roadway the luminaire having the reflector according to the present invention would be mounted on a pole adjacent the side of the roadway with the angle from nadir to 65° encompassing the entire width of the roadway.

The present invention provides a reflector for a luminaire wherein the first section of the reflector from 117° to 180° from nadir is a cylindrical section. The next adjacent section of the reflector which extends from 180° to 270° from nadir is provided with a general contour curve which will redirect the flux in the zone from nadir to 65°. The third section which is adjacent to the second section and extends from 270° to 355° from nadir is also provided with a general contour curvature which will redirect the flux in the zone from 50° to 65° from nadir. The general contour curves for the second and third sections are defined by fourth order polynominal equation having different constants.

The present invention provides a luminaire wherein the reflector described hereinbefore is placed in an enclosure which may be provided with a plane, clear, flat lens and housing wherein the lens is disposed at an angle of 50° from nadir so that light rays which are reflected off the lens surface are not re-reflected at an angle above the peak angle. The physical blockage of the housing for the luminaire according to the present invention provides the desired cut-off for light.

The foregoing and other objects, features and advantages of the invention will be apparent from the following more particular description of a preferred embodiment of the invention as illustrated in the accompanying drawings.

BRIEF DESCRIPTION OF THE DRAWINGS

FIG. 1 is a perspective view of a luminaire according to the present invention.

FIG. 2 is a schematic view showing the curvature and light distribution pattern for a reflector according to the present invention.

FIG. 3 is a transverse sectional view of the luminaire shown in FIG. 1.

FIG. 4 is a graph showing the light distribution of a reflector according to the present invention as compared to theoretically perfect light distribution.

DETAILED DESCRIPTION OF THE PREFERRED EMBODIMENTS

The luminaire 10 according to the present invention is comprised of a substantially rectangular housing 12 which is in effect beveled along one corner to define an opening over which the lens 14 is placed to define a completely closed housing. Within the housing a reflector 16 is mounted which extends from one end of the housing to the other with the edges 18 of the reflector being disposed contiguous to one edge of the lens 14. The other edge 20 of the reflector is contiguous with a baffle 22 of any suitable material which extends from the edge 20 to the other longitudinal edge of the lens 14. A tubular light source 24 is mounted within the housing by any suitable means and is disposed parallel to the reflector 16 and the lens 14. The various electrical connections for the tubular light source 24 have not been illustrated as these are well known in the art and the various possible means for mounting the luminaire have also been illuminated since they do not relate to the present invention.

Referring to FIG. 2 a schematic outline of the reflector 16 according to the present invention is illustrated with respect to $x$ and $y$ coordinates wherein the $y$ coordinate is considered nadir. In the proposed reflector 16 three distinct contours are used to provide the optimum distribution of light flux. All three may not be required for all applications. For example, in the illumination of signboards it may be desirable to eliminate section 26 or to substitute a different reflecting or refracting scheme in its place. For other applications it may be desirable to decrease the illumination in close proximity to the location of the luminaire. Modifying section 28 would accomplish this.

However, in the preferred form of the invention section 26 is a cylindrical section which extends from 117° to 180° from nadir. When its focal point coincides with that of section 30 and is at the origin 32 of the coordinate system, radiation from this section best reinforces the radiation from section 30. This, however, also redirects a considerable amount of radiation back through the light source which is located at 32. For applications when this undesirable, the focal point of the cylindrical section 26 may be placed at the extreme topmost edge of the tubular light source, that is, on the surface of the tubular light source 24. This will result in less radiation being redirected through the source but also provides less contribution to reinforce section 30. The equation for section 26 is of the form $Ax^2 + By^2 = C^2$.

Section 28 is a general contour which can be used to redirect flux in the zone from nadir to 65° from nadir. In the embodiment shown the contour extends from 180° to 270° from nadir. This section is contoured so that uniform illumination results in the area from the luminaire location (nadir) to approximately 65° from nadir. As noted above, this section can be modified or portions of its eliminated when other light distributions are desired. In the preferred embodiments, the equation of this section is given by: $Az^4 + Bx^3 + Cx^2 = Dx - E = y$.

In the luminaire designed for the largest currently available light source, these constants are $A = 0.01239$, $B = 0.0690$, $C = 0.206$, $D = 0.0937$, $E = 4.4103$. This contour is an extension of the main reflector contour and its output should be matched to the output of the main reflector to provide the proper uniformity of illumination.

Section 30 is a general contour which redirects the flux into the zone from 50° to 65° from nadir in the preferred embodiment. In the embodiment shown this section extends from 270° to 355° from nadir. It should be noted that this contour can be adjusted to emit the peak intensity at any angle between 45° and 75° from nadir. In the preferred embodiment the equation of this section is given by $Ax^4 - Bx^3 + Cx^2 - Dx - E = y$. In the luminaire design for the largest currently available light source these constants are $A = 0.0000351$, $B = 0.00192$, $C = 0.0486$, $D = 0.229$, $E = 4.436$.

When the reflector 16 is used in the luminaire 10 the relationship of the lens 14 to the reflector 16 and the relationship of the housing 12 to the reflector 16 have a preferred orientation for optimum performacne.

In order to prevent light rays from being omitted above the peak angle of 65° from nadir, it is necessary to provide a lens of the corrent type in orientation. When a plain, clear, flat lens is used the preferred orientation is as shown in FIGS. 1 and 2. The angle of 50° from nadir is desirable so that the light rays which are reflected off the lens surface are not re-flected at an angle above the peak angle. An angle greater than 50° can be used but this will result in a larger fixture enclosure.

It is also possible to use a plain, clear, flat coated lens which would be disclosed substantially parallel to nadir and extending from the edge 20 of the reflector 16. This lens is coated with an anti-reflective coating which would reduce the lens reflectance. For optimum performance the lens should be coated on both sides. While this method does not completely eliminate the lens reflection problem it does reduce significantly the reflected light which would be omitted above the peak angle.

In the preferred embodiment the physical blockage of the housing 12 provides the desired cut-off of light above the peak angle. To obtain the distribution shown the preferred housing embodiment intersects the 65° line from the light source. The inside of the housing must be treated with a light absorbing paint or texture to prevent light rays from being emitted above the peak angle.

While the invention has been particularly shown and described with reference to a preferred embodiment it will be understood by those in the art that various changes in form and details may be made therein without departing from the spirit and scope of the invention.

What is claimed is:

1. A light reflector having an elongated reflecting surface of uniform concave cross-section including a first curved portion of circular cross-section the center of which is adapted to be disposed substantially coincident with the axis of an elongated light source, said first curved portion extending from 117° to 180° from nadir, a second curved portion which is a smooth continuation of said first curved portion extending from 180° to 270° from nadir for redirecting light in the zone from nadir to 65° and a third curved portion which is a smooth continuation of said curved portion extending from 270° to 355° from nadir for redirecting light in the zone from 50° to 65° from nadir; said second and third curved portions being defined by fourth degree polynominal equations and being adapted to reflect light directly received from said light source as well as light reflected from said first curved portion back through said light source to provide substantially uniform illumination of a plane surface disposed perpendicular to a line coincident with the radius of said first curved portion at the point of merger between said first and second curved portions.

2. A luminaire for providing uniform illumination of a plane surface spaced from said luminaire and disposed perpendicular to nadir, said luminaire comprising an elongated light source having the longitudinal axis thereof disposed perpendicular to nadir, elongated reflector means disposed parallel to the axis of said light source and having a reflecting surface of uniform concave cross-section including a first curved portion of circular cross-section the center of which is adapted to be disposed substantially coincident with the axis of said elongated light source, said first curved portion extending from 117° to 180° from nadir, a second curved portion which is a smooth continuation of said first curved portion extending from 180° to 270° from nadir to refirecting light in the zone from nadir to 65° and a third curved portion which is a smooth continuation of said second curved portion extending from 270° to 355° from nadir for redirecting light in the zone from 50° to 65° from nadir; said second and third curved portions being defined by fourth degree polynominal equations and being adapted to reflect light directly received from said light source as well as light reflected from said first curved portion back through said light source to provide substantially uniform illumination of said plane surface and housing means for mounting said light source and said reflector means in proper relation to each other.

3. A luminaire as set forth in claim 2 wherein said housing is provided with a rectangular opening with the longitudinal edge of said third curved portion being contiguous with one longitudinal edge of said opening, the longitudinal edge of said first curved portion being spaced from and parallel to the oppsite longitudinal edge of said opening and a lens disposed in said opening and intersecting nadir at an angle no less than 50° to prevent light rays which are reflected off the lens surface from being re-reflected by said reflector.

4. A luminaire as set forth in claim 3 further comprising baffle means disposed within said housing between said longitudinal edge of said first curved section and said opposite longitudinal edge of said opening.

* * * * *